United States Patent [19]

Benting

[11] Patent Number: 4,918,767

[45] Date of Patent: Apr. 24, 1990

[54] SHAMPOO CHAIR AND BOWL APPARATUS

[75] Inventor: Gary M. Benting, Rockford, Ill.

[73] Assignee: Smith Investment Company, Belvidere, Ill.

[21] Appl. No.: 357,907

[22] Filed: May 30, 1989

[51] Int. Cl.[5] ..... A45D 19/00; A45D 44/10

[52] U.S. Cl. ..... 4/517; 4/518; 4/523

[58] Field of Search ..... 4/515–523; 297/DIG. 4, 182, 189, 194; 248/143; 414/678

[56] References Cited

U.S. PATENT DOCUMENTS

| | | | |
|---|---|---|---|
| 555,860 | 3/1896 | Hanger | 4/517 |
| 1,309,694 | 7/1919 | Pritchard | 4/517 |
| 1,329,058 | 1/1920 | Nainka | 4/517 |
| 2,332,904 | 10/1943 | Ellinger | 4/517 |
| 3,292,186 | 12/1966 | Turmenne et al. | 4/519 |
| 3,447,645 | 6/1969 | Dorner et al. | 188/269 |
| 3,856,287 | 12/1974 | Freitag | 267/64.11 |
| 3,879,085 | 4/1975 | Morel | 297/182 |
| 4,192,549 | 3/1980 | Peterson | 248/143 |
| 4,790,716 | 12/1988 | McConnell | 414/678 |
| 4,841,584 | 6/1989 | Overcash et al. | 4/519 |

*Primary Examiner*—Henry K. Artis

*Attorney, Agent, or Firm*—Vernon J. Pillote

[57] ABSTRACT

A shampoo chair and bowl apparatus in which the shampoo bowl is mounted with a neck rest at a fixed elevation, and a shampoo chair is mounted for adjustment along a linear guide path inclined upwardly and rearwardly toward the shampoo bowl between a lower and an upper position. The chair frame and guide are arranged to support and guide the chair during movement along the guide path with the back rest extending upwardly and rearwardly from the seat generally parallel to the guide path toward the neck rest on the shampoo bowl. Seat adjustment apparatus is provided for stopping the chair in a selected adjusted position between the upper and lower positions.

12 Claims, 1 Drawing Sheet

SHAMPOO CHAIR AND BOWL APPARATUS

BACKGROUND OF THE INVENTION

When shampooing hair in a beauty or barber shop, it is common practice to seat the individual in a chair with the head tilted back to rest in the neck rest of a shampoo bowl. Some shampoo chairs are provided with an adjustable tilt mechanism to enable adjusting the angle of at least the back rest of the chair and, in order to accommodate people of different height, the chair is either moved horizontally on casters relative to the shampoo bowl or the individual is required to slide down in the chair in order to position the individual's neck on the neck rest of the shampoo bowl. It has also been proposed, as disclosed in U.S. Pat. No. 2,332,904, to provide a shampoo chair and bowl apparatus in which the chair is mounted for horizontal movement on a carriage toward and away from the bowl and apparatus is provided for vertically raising the chair relative to the carriage, in order to position people of different height with their neck in proper position relative to the neck rest on the shampoo bowl. This arrangement requires separate horizontal and vertical adjustment of the position of the chair relative to the shampoo bowl and, in practice, would probably require one or more readjustments of either or both the horizontal and vertical positions of the chair in order to properly position the neck of each different occupant on the neck rest in the shampoo bowl. Some other shampoo bowl and chair apparatus such as disclosed in U.S. Pat. Nos. 1,329,058; 3,292,186 and 3,879,085, mount a bowl or receptacle on the chair. However, such apparatus are not satisfactory since they require flexible water supply and drain lines if the shampoo bowl and/or chair are movable.

SUMMARY OF THE INVENTION

It is the object of the present invention to overcome the disadvantage of the prior art by providing a shampoo chair and bowl apparatus which simplifies adjustment of the position of the chair relative to a fixed shampoo bowl to accommodate individuals of different height.

Accordingly, the present invention provides a shampoo chair and bowl apparatus comprising a shampoo bowl having water supply and drain fittings, a front side, a neck receiving depression in the front side defining an upwardly and forwardly facing neck rest at the bottom of the depression, and means mounting the shampoo bowl with a neck rest at a fixed elevation above the floor. The shampoo chair includes a stationary base adapted to rest on a floor at a fixed location in front of the shampoo bowl, a movable chair frame, a seat and a back rest mounted on the chair frame for movement as a unit therewith, and guide means mounting the chair frame on the base for movement along a linear guide path inclined upwardly and rearwardly at a preselected angle toward the shampoo bowl between a lower and an upper position, the chair frame and guide means being constructed and arranged to guide the chair frame along the guide path with the back rest extending upwardly and rearwardly generally parallel to the guide path toward the neck rest on the shampoo bowl. Means are provided for adjustably stopping the chair frame in selected positions intermediate the upper and lower positions. The chair frame is preferably yieldably urged to a raised position with a force sufficient to raise the chair when it is not occupied and, after the occupant is in the chair, the chair is allowed to move downwardly under the weight of occupant and stopped at the intermediate position in which the individual's neck is adjacent the neck rest.

DETAILED DESCRIPTION

Figure 1:
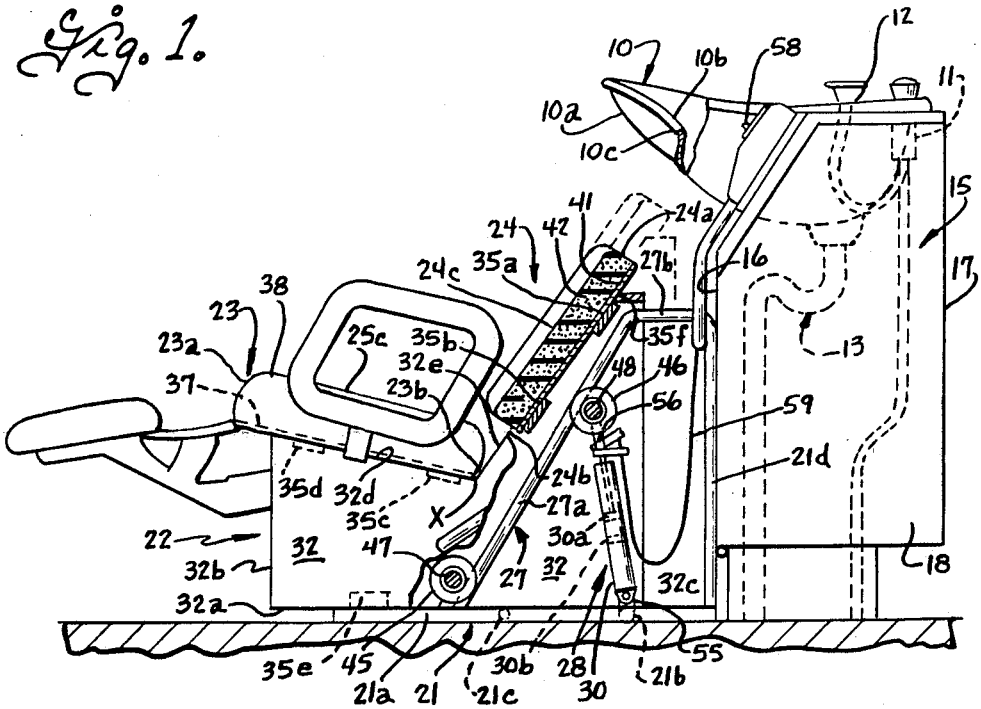
FIG. 1 is a side elevational view of one embodiment with parts broken away and shown in section to illustrate details of construction.

Referring now to FIG. 1, there is shown a shampoo chair and bowl apparatus comprising a shampoo bowl 10 having a conventional water supply valve fittings 11 and shampoo head 12, and drain fittings 13. The shampoo bowl has a front side 10*a*, a neck receiving depression 10*b* in the front side defining an upwardly and forwardly facing neck rest 10*c*. In the embodiment of FIG. 1, the shampoo bowl is shown mounted on a cabinet 15 having a front 16, rear 17 and ends 18. The shampoo bowl extends forwardly of the front of the cabinet and the cabinet is arranged so that the beautician or barber can stand at the rear side of the cabinet during the hair washing operation.

The shampoo chair includes a stationary base 21 adapted to rest on the floor at the front side of the shampoo bowl and a movable chair frame 22 having a seat 23 and back rest 24 mounted thereon for movement as a unit therewith. The back rest 24 is inclined rearwardly at an angle that will comfortably support the back of the occupant during shampooing, preferably in a range of about 20° to 45° to the vertical. Guide means 27 are provided for mounting the chair frame on the base for movement along the linear guide path inclined upwardly and rearwardly at a preselected angle toward the shampoo bowl, between a lower position shown in solid lines in FIG. 1 and an upper position indicated by the phantom lines in FIG. 1, and the chair and guide means are constructed and arranged to support and guide the chair frame along the guide path with the back rest extending generally parallel to the guide path toward the neck rest on the shampoo bowl. A means 28 is provided for adjusting and stopping the chair in a selected adjusted position along the path.

The base 21 is conveniently formed of tubular stock and includes laterally spaced base members 21*a* adapted to rest on the floor and interconnected by cross members 21*b* and 21*c*, and spaced uprights 21*d* attached to the front 16 of the cabinet 15 by suitable fasteners (not shown) to maintain the base in fixed relation to the shampoo bowl. The guide means includes laterally spaced guide rails 27*a* that are attached at their lower ends to the base members 21*a* and which have their upper ends 27*b* attached to the upper ends of the uprights 21*d*. The guide rails 27*a* are also conveniently of tubular stock and extend upwardly and rearwardly from the base members toward the shampoo bowl 10 on the cabinet.

The movable chair frame 22 includes laterally spaced side members conveniently in the form of relatively parallel panels 32 each having a generally horizontal lower edge 32*a*, and upright forward and rear edges 32*b* and 32*c*. The panels are cut away to receive the seat 23 and back rest 24 and have an upper edge 32*d* that extends upwardly and forwardly from a point X to receive the seat 23 and an edge 32*e* that extends upwardly and rearwardly to receive the back rest 24. Cross members 35*a*, 35*b* extend between the side frames to support the back rest and cross members 35*c* and 35*d* extend between the side members 32 to support the seat. Additional cross members 35*e* ,and 35*f* extend between the side members 32 to rigidify and support the same in generally parallel relation.

The seat 23 includes a base 37 supported on the cross members 35*c* and 35*d*, a resilient pad 38 of foam, fibers or the like, covered by a suitable cover. The seat 23 has forward and rear edges 23*a* and 23*b* and an upper occupant engaging face 25*c*. The back rest 24 includes a rigid base 41 attached to the cross members 35*a* and 35*b*, and a resilient pad 42 of foam, fiber or the like and a suitable cover. The back rest 42 has upper and lower edges 24*a* and 24*b* and a forward occupant engaging face 24*c*. As shown, the back rest 24 is preferably horizontally curved or contoured for occupant comfort.

The chair frame is guided for movement along the rails 27*a* and in the preferred embodiment illustrated, the guides comprise lower and upper pairs of rollers 45 and 46 mounted on axles 47 and 48 that extend between and are secured to the side panels 32 of the chair frame. The lower rollers 45 are conveniently arranged to engage the forward side of the tubular rails 27*a* and the upper rollers 46 arranged to engage the underside of the tubular rails at a location spaced above the lower rollers. The upper and lower rollers guide the chair frame for movement in a linear guide path along the upwardly and rearwardly inclined rails 27*a* and the back rest is supported on the chair frame with the back rest extending generally parallel to the path of movement of the chair frame along the guide rails. The back rest is arranged to support the back of occupant in the chair when the occupant's neck is positioned in the neck rest on the shampoo bowl. The human neck curves forwardly somewhat from the back and the occupant supporting surface 24*c* is arranged to support the occupant's back when it is resting comfortably in the neck rest on the shampoo bowl. For this purpose, the occupant engaging surface 24*c* on the back rest is arranged so that it is offset slightly below, for example about one or one and one-half inches below, a line extending downwardly and forwardly from the neck rest and parallel to the guide rails 27*a* so that the occupant engaging surface is offset slightly below the neck of the shampoo bowl in all adjusted positions of the chair. In the embodiment of FIG. 1, the guide rails 27*a* are disposed at an angle of about 60° to the base members 21*a* (about 30° to the vertical), and the back rest 24 is supported on the chair frame so as to extend at an angle of about 30° to 35° to the vertical. The seat 23 is mounted on the chair frame so as to extend upwardly and forwardly at a shallow included angle of about 15° to the horizontal. A leg rest 51, conveniently of the extendable and retractable type, is advantageously provided on the chair to support the occupant's legs.

It is contemplated that the chair adjusting means could be any conventional type used for adjustable barber and beauty salon chairs. Preferably the chair adjusting means is of a type which is operative to yieldably urge the chair frame to its upper position when the chair is not occupied, and to stop or lock the chair during downward movement when the chair is occupied. The adjusting means 28 conveniently comprises an adjustable gas spring. The adjustable gas spring is of conventional construction and may, for example, be of the type disclosed in U.S. Pat. No. 3,497,645. As more fully disclosed in that patent, the adjustable gas spring includes a cylinder 30, an actuator piston 30*a* slidable in the cylinder and having a piston rod extending out from one end, and a floating piston 30*b* between the actuator piston and the closed end of the cylinder. A compressed gas is contained in the cylinder between the closed end and the floating piston and a liquid fills the compartments at either side of the actuator piston. An orifice is provided for regulating flow of liquid from one side of the actuator piston to the other to control the rate of extension and retraction of the gas spring, and a bypass valve controls flow through the orifice and is operable to close the orifice to stop the unit in a preselected position. As shown in FIG. 1, the cylinder is mounted by a bracket 55 on the base and the piston rod is connected by a bracket 56 to the upper axle 48 to raise the chair frame under the gas pressure in the cylinder below the floating piston, when the chair is not occupied and the bypass valve is opened. The bypass valve for the adjustable gas spring is arranged for remote operation by a manually operated actuator 58 through a bowden wire or cable 59 from a manually operable actuator 61 positioned at a convenient fixed location.

Figure 2:
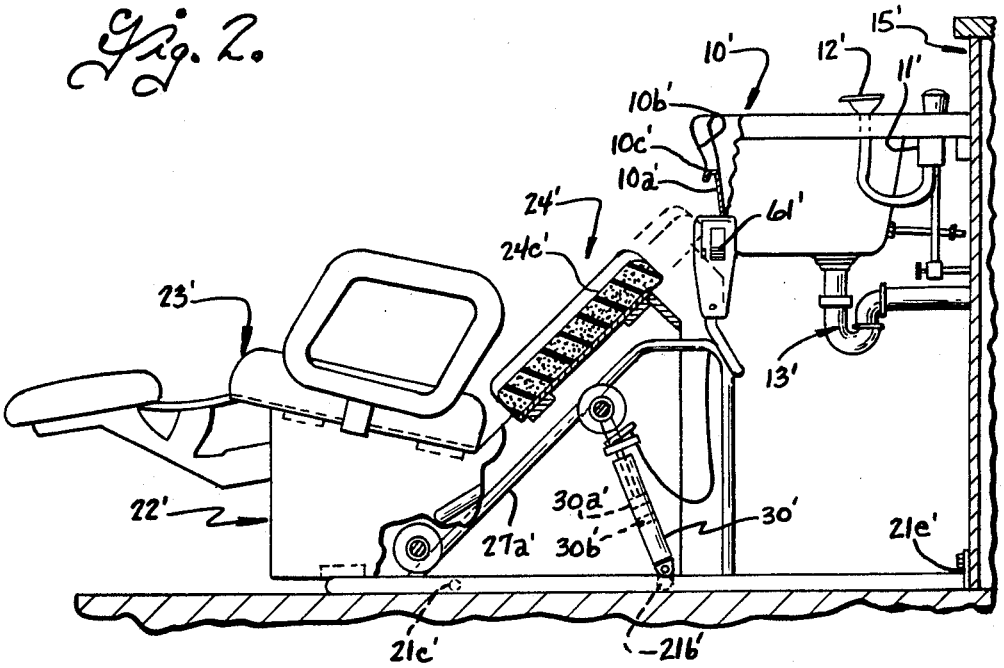
FIG. 2 is a side elevational view of a second embodiment, with parts broken away and shown in section to illustrate details of construction.

A modified form of shampoo chair and bowl is illustrated in FIG. 2 and like numerals are used to designate the same parts with the same numerals followed by the subscript 'used to designate modified parts. In this embodiment, a shampoo bowl 10' is mounted on a bulkhead 15 at a somewhat lower height than in the embodiment of FIG. 1, and the shampoo bowl extends forwardly of the bulkhead so that the operator can stand at the side of the bowl during the shampoo operation. The shampoo bowl has a front wall 10*a'*, a neck receiving depression 10*b'* in the front wall and an upwardly and forwardly facing neck rest 10*c'* at the bottom of the depression. As in the preceding embodiment, the shampoo bowl has inlet water supply fixtures 11', a shampoo head 12' and drain fittings 13'.

The shampoo chair includes a stationary base 21' having base members 21*a'* interconnected by cross members 21*b'* and 21*c'* and secured at their rear ends 21*e'* to the bulkhead 15' to maintain the base in fixed relation to the shampoo bowl. In order to accommodate the lower bowl height and provide adequate chair adjustment, the guide rails 27*a'* on the base frame are inclined upwardly and rearwardly toward the front of the shampoo bowl at an angle of about 45°. The chair frame 22' is arranged to support the seat 23' at about the same upwardly inclined attitude as the embodiment in FIG. 1. However, the chair frame is modified to support the back rest 24' to extend upwardly and rearwardly generally parallel to the path of movement of the chair frame along the guide rails 27*a'*, that is at an angle of about 45° to the vertical. As in the preceding embodiment, the path of movement of the occupant engaging face 24*c'* of the back rest extends toward the neck rest on the shampoo bowl but is offset slightly below, for example about one or one and one-half inches below, a line extending downwardly from the neck rest 10*c'* and parallel to the guide rails 27*a*. The chair adjusting means 28' is conveniently an adjustable gas cylinder 30' having an actuator piston 30*a'* and a floating piston 30*b'* similar to the adjustable gas cylinder 28 and arranged to be remotely operated by an actuator 61' at a convenient fixed location.

From the foregoing it is believed that the construction and operation of the shampoo chair and bowl apparatus will be, readily understood. The shampoo bowl is fixedly mounted with the neck rest at a fixed elevation above the floor and the shampoo chair is guidably mounted on the base for movement along a linear guide path inclined upwardly and rearwardly a preselected angle toward the shampoo bowl, and the chair frame and guide means are arranged to support and guide the chair frame during movement along the path with the back rest extending upwardly and rearwardly from the seat generally parallel to the path toward the neck rest on the shampoo bowl. Thus, the shampoo chair can be easily adjusted relative to the neck rest on the shampoo bowl to accommodate occupants of different height. The chair adjuster 28 yieldably urges the chair upwardly with a force sufficient to move it to a raised position when the chair is not occupied, and when the chair is thereafter occupied, the adjuster can be selectively operated to allow the chair to move downwardly at a controlled rate and then stop the chair at the desired position.

The embodiments of the invention in which an exclusive property or privilege is claimed are defined as follows:

1. A shampoo chair and bowl apparatus comprising, a shampoo bowl having water supply and drain fittings, a front side, a neck receiving depression in the front side defining an upwardly and forwardly facing neck rest at the bottom of the depression, and means mounting the shampoo bowl with the neck rest at a selected elevation above a floor, a shampoo chair including a stationary base adapted to rest on a floor at the front side of the shampoo bowl, a movable chair frame and a seat and a back rest fixed to the frame for movement as a unit therewith, guide means mounting the chair frame on the base for movement along a linear guide path inclined upwardly and rearwardly at a preselected angle toward the shampoo bowl between a lower and an upper position, the chair frame and guide means being constructed and arranged to support and guide the chair frame during movement along said guide path with the back rest extending upwardly and rearwardly from the seat generally parallel to said guide path toward the neck rest on the shampoo bowl, and selectively operable means for positioning the chair frame in different adjusted positions between said raised and lowered positions.

2. A shampoo chair and bowl apparatus according to claim 1 including means for yieldably urging the chair frame upwardly with a force sufficient to move the chair to the raised position when the seat is not occupied and for controlling the rate of downward movement when the seat is occupied.

3. A shampoo chair and bowl apparatus according to claim 1 wherein said guide means includes guide rails mounted on the base and inclined upwardly and rearwardly, and follower means on said chair frame engaging said guide rails.

4. A shampoo chair and bowl apparatus according to claim 3 including adjustable gas spring means for yieldably urging the chair frame upwardly with a force sufficient to move the chair frame to the raised position when the seat is not occupied and for controlling the rate of downward movement of the chair frame when the seat is occupied.

5. A shampoo chair and bowl apparatus according to claim 1 wherein said guide means includes a pair of laterally spaced guide rails mounted on the base and extending upwardly and rearwardly, the rails having forward and rear sides, a pair of lower rollers mounted on said chair frame and engaging the forward sides of the rails, a pair of upper rollers mounted on an upper axle attached to the chair frame and engaging the rear sides of the rails at locations spaced above the lower rollers, adjustable gas spring means attached to the upper axle and to the base for yieldably urging the chair frame to a raised position when the chair seat is not occupied and for controlling the rate of downward movement of the chair frame when the seat is occupied.

6. A shampoo chair and bowl apparatus according to claim 1 including a leg rest mounted on the chair frame at a forward side thereof for movement with the chair frame.

7. A shampoo chair and bowl apparatus according to claim 1 wherein the backrest is inclined upwardly and rearwardly from the seat at an angle in the range of about 20° to 45° from the vertical.

8. A shampoo chair and bowl apparatus according to claim 7 wherein the seat is inclined upwardly and forwardly from the back rest at an angle in a range of about 10° to 15° to the horizontal.

9. A shampoo chair and bowl apparatus comprising, a shampoo bowl having water supply and drain fittings, a front side, a neck receiving depression in the front side defining an upwardly and forwardly facing neck rest at the bottom of the depression, and means mounting the shampoo bowl with the neck rest at a selected elevation above a floor, a shampoo chair including a stationary base adapted to rest on a floor at the front side of said shampoo bowl, a movable chair frame having a seat and a back rest fixed to the frame for movement as a unit therewith, with the back rest disposed at an angle of substantially greater than 90° to the seat, means including guide means mounting the chair frame on the base with a back rest inclined upwardly and rearwardly from the seat at an angle to support the back of an occupant in the chair when the occupant's neck is in the neck rest on the shampoo bowl, the guide means guiding the chair frame for movement along a substantially linear guide path generally paralleling the backrest between a lower position and a raised position to accommodate persons of different height, and means for selectively positioning the chair frame in positions intermediate the raised and lowered positions.

10. A shampoo chair and bowl apparatus according to claim 9 including means for yieldably urging the chair frame upwardly with a force sufficient to move the chair to the raised position when the seat is not occupied, and means for controlling the rate of downward movement of the chair frame when the seat is occupied.

11. A shampoo chair and bowl apparatus comprising, a shampoo bowl having water supply and drain fittings, a front side, a neck receiving depression in the front side defining an upwardly and forwardly facing neck rest at the bottom of the depression, and means mounting the shampoo bowl with the neck rest at a selected elevation above the floor, a shampoo chair including a stationary base adapted to rest on a floor at the front side of the shampoo bowl, a movable chair frame, a seat mounted on the chair frame for movement as a unit therewith and having an occupant engaging face, a back rest mounted on the chair frame for movement as a unit therewith and an occupant engaging face extending upwardly and rearwardly at an angle of substantially greater than 90° to the occupant engaging face of the seat, guide means mounting the chair frame on the base for movement along a linear guide path inclined upwardly and rearwardly at a preselected angle toward the shampoo bowl between a lower and an upper position, the chair frame and guide means being constructed and arranged to support and guide the chair frame along said path with the occupant engaging face extending upwardly and rearwardly generally parallel to the said guide path toward the neck rest on the shampoo bowl, and adjustable gas spring means for yieldably urging the chair frame toward the upper position when the chair is not occupied and for controlling the rate of downward movement of the chair frame when the chair is occupied, and selectively operable means for controlling said adjustable gas spring for stopping the chair frame in selected positions intermediate said upper and lower positions.

12. A shampoo chair and bowl apparatus according to claim 11 wherein the occupant engaging face on the back rest is offset slightly below a line extending downwardly and forwardly from the neck rest and parallel to the guide path.

* * * * *